US012416176B2

(12) United States Patent
Richards

(10) Patent No.: US 12,416,176 B2
(45) Date of Patent: Sep. 16, 2025

(54) BASE CONNECTIONS AND STRUCTURES INCLUDING THE BASE CONNECTIONS, KITS FOR FORMING AND METHODS OF REPAIRING THE SAME

(71) Applicant: Durafuse Frames, LLC, West Jordan, UT (US)

(72) Inventor: Paul Williams Richards, Orem, UT (US)

(73) Assignee: Durafuse Frames, LLC, West Jordan, UT (US)

( * ) Notice: Subject to any disclaimer, the term of this patent is extended or adjusted under 35 U.S.C. 154(b) by 0 days.

(21) Appl. No.: 17/715,418

(22) Filed: Apr. 7, 2022

(65) Prior Publication Data

US 2022/0333397 A1 Oct. 20, 2022

Related U.S. Application Data

(60) Provisional application No. 63/174,663, filed on Apr. 14, 2021.

(51) Int. Cl.
*E04H 9/02* (2006.01)
*E04B 1/24* (2006.01)

(52) U.S. Cl.
CPC ..... *E04H 9/021* (2013.01); *E04B 1/2403* (2013.01); *E04B 2001/2415* (2013.01);
(Continued)

(58) Field of Classification Search
CPC ..... E04H 9/021; E04H 9/024; E04B 1/2403; E04B 2001/2415; E04B 2001/2418;
(Continued)

(56) References Cited

U.S. PATENT DOCUMENTS 1,727,293 A 9/1929 Andrew
4,014,089 A 3/1977 Sato et al.
(Continued)

FOREIGN PATENT DOCUMENTS

CN 109723145 A 5/2019
EP 3387196 B1 11/2020
(Continued)

OTHER PUBLICATIONS

Corrected Notice of Allowance for U.S. Appl. No. 15/500,991 mailed May 8, 2019.
(Continued)

*Primary Examiner* — Phi D A
*Assistant Examiner* — Phi D Tran
(74) *Attorney, Agent, or Firm* — Ballard Spahr LLP

(57) ABSTRACT

Embodiments are directed to base connections, structures including base connections, kits for forming the base connections and/or structures, and method of repairing yielded base connections. In an embodiment, a base connection includes a base plate including a top surface and a bottom surface opposite the top surface. The top surface is configured to be adjacent to a terminal end of a column and the bottom surface adjacent to a foundation. The connection also includes one or more anchor rods attached to the base plate. The anchor rods are configured to secure the base plate to the foundation. The connection includes at least one structural fuse configured to be attached to the column and attached to the base plate. The fuse includes a plate with at least one cutout formed therein. The cutout is configured to form one or more yield regions that are configured to preferentially yield.

17 Claims, 6 Drawing Sheets

(52) U.S. Cl.
CPC ..... *E04B 2001/2418* (2013.01); *E04B 2001/2442* (2013.01); *E04B 2001/2463* (2013.01); *E04B 2001/2469* (2013.01); *E04H 9/024* (2013.01)

(58) Field of Classification Search
CPC ..... E04B 2001/2442; E04B 2001/2463; E04B 2001/2469
See application file for complete search history.

(56) References Cited

U.S. PATENT DOCUMENTS

| | | | | |
|---|---|---|---|---|
| 4,926,592 | A * | 5/1990 | Nehls | E01F 9/685 40/607.05 |
| 5,148,642 | A | 9/1992 | Plumier et al. | |
| 5,660,017 | A | 8/1997 | Houghton | |
| 6,073,405 | A | 6/2000 | Kasai et al. | |
| 6,138,427 | A | 10/2000 | Houghton | |
| 6,264,162 | B1 * | 7/2001 | Barnes | E01F 9/638 248/548 |
| 6,739,099 | B2 | 5/2004 | Takeuchi et al. | |
| 7,040,069 | B2 | 5/2006 | Simmons | |
| 7,530,205 | B2 | 5/2009 | Simmons | |
| 8,683,758 | B2 | 4/2014 | Christopoulos et al. | |
| 8,800,239 | B2 | 8/2014 | Yang | |
| 8,875,452 | B2 | 11/2014 | Kawai et al. | |
| 9,091,065 | B2 | 7/2015 | Tran et al. | |
| 9,163,424 | B2 | 10/2015 | Montgomery et al. | |
| 9,200,442 | B2 | 12/2015 | Richards | |
| 9,441,360 | B2 | 9/2016 | Matteson | |
| 9,464,427 | B2 | 10/2016 | Karns | |
| 9,506,239 | B2 | 11/2016 | Houghton | |
| 9,514,907 | B2 | 12/2016 | Mcmanus et al. | |
| 10,316,507 | B2 | 6/2019 | Richards | |
| 10,584,477 | B2 | 3/2020 | Richards | |
| 10,669,718 | B2 | 6/2020 | Pryor et al. | |
| 10,689,876 | B2 | 6/2020 | Richards | |
| 10,760,261 | B2 | 9/2020 | Richards | |
| 11,162,260 | B2 | 11/2021 | Pryor | |
| 11,479,988 | B2 * | 10/2022 | Curtis | E04H 12/2253 |
| 11,808,026 | B2 | 11/2023 | Zhao et al. | |
| 2002/0184836 | A1 | 12/2002 | Takeuchi et al. | |
| 2004/0050013 | A1 | 3/2004 | Okada et al. | |
| 2004/0144006 | A1 | 7/2004 | Chu | |
| 2004/0200178 | A1 | 10/2004 | Simmons | |
| 2004/0237456 | A1 | 12/2004 | Simmons | |
| 2005/0055970 | A1 | 3/2005 | Simmons | |
| 2005/0204684 | A1 | 9/2005 | Houghton | |
| 2006/0144006 | A1 * | 7/2006 | Suzuki | E04H 9/024 52/655.1 |
| 2006/0265992 | A1 | 11/2006 | Hiragaki | |
| 2009/0223166 | A1 * | 9/2009 | Ohata | E04B 1/2403 52/699 |
| 2010/0205876 | A1 | 8/2010 | Christopoulus et al. | |
| 2010/0205891 | A1 | 8/2010 | Bong et al. | |
| 2011/0030305 | A1 | 2/2011 | Karns | |
| 2012/0017523 | A1 | 1/2012 | Ozaki et al. | |
| 2013/0074427 | A1 | 3/2013 | Kawai et al. | |
| 2014/0062648 | A1 * | 3/2014 | McManus | E04H 9/0237 337/188 |
| 2014/0182234 | A1 | 7/2014 | Yang | |
| 2014/0325932 | A1 | 11/2014 | Karns et al. | |
| 2015/0096244 | A1 | 4/2015 | Richards | |
| 2015/0101268 | A1 | 4/2015 | Montgomery et al. | |
| 2015/0275501 | A1 | 10/2015 | Houghton | |
| 2016/0208478 | A1 | 7/2016 | Matteson | |
| 2016/0215492 | A1 | 7/2016 | Karns | |
| 2016/0356033 | A1 | 12/2016 | Houghton et al. | |
| 2017/0268252 | A1 | 9/2017 | Gray et al. | |
| 2018/0266099 | A1 | 9/2018 | Lippert | |
| 2018/0274223 | A1 | 9/2018 | Richards | |
| 2018/0347222 | A1 | 12/2018 | Richards | |
| 2019/0040645 | A1 * | 2/2019 | Zhao | E04B 1/2403 |
| 2019/0292783 | A1 | 9/2019 | Pryor et al. | |
| 2020/0109556 | A1 * | 4/2020 | Pryor | E04C 3/06 |
| 2021/0079681 | A1 * | 3/2021 | Pryor | E04H 9/024 |
| 2022/0154445 | A1 * | 5/2022 | Zhao | E04B 1/98 |
| 2022/0333369 | A1 | 10/2022 | Richards | |
| 2022/0333397 | A1 | 10/2022 | Richards | |
| 2023/0058224 | A1 | 2/2023 | Evans et al. | |
| 2023/0110886 | A1 | 4/2023 | Abela | |
| 2023/0117355 | A1 | 4/2023 | Robinson | |
| 2023/0175248 | A1 | 6/2023 | Richards | |
| 2024/0076892 | A1 | 3/2024 | Gray et al. | |
| 2024/0392567 | A1 | 11/2024 | Felix | |

FOREIGN PATENT DOCUMENTS

| | | | |
|---|---|---|---|
| JP | 2000144901 | A | 5/2000 |
| JP | 2002364068 | A | 12/2002 |
| JP | 2006233445 | A | 9/2006 |
| JP | 6876510 | B2 | 4/2021 |
| KR | 20040106829 | A | 12/2004 |
| KR | 100516332 | B1 | 9/2005 |
| KR | 101344813 | B1 | 12/2013 |
| KR | 20140039385 | A | 4/2014 |
| KR | 101406485 | B1 | 7/2014 |
| KR | 20140105643 | A | 9/2014 |
| WO | 2014085680 | A1 | 6/2014 |
| WO | 2016036564 | A1 | 3/2016 |
| WO | 2017100453 | A1 | 6/2017 |
| WO | 2019040297 | A1 | 2/2019 |
| WO | 2021030111 | A1 | 2/2021 |

OTHER PUBLICATIONS

Corrected Notice of Allowance for U.S. Appl. No. 16/394,665 mailed Feb. 11, 2020.
International Search Report and Written Opinion from International Application No. PCT/US2015/047006 mailed Nov. 23, 2015.
International Search Report and Written Opinion from International Application No. PCT/US2016/065623 mailed Mar. 10, 2017.
International Search Report and Written Opinion from International Application No. PCT/US2018/046222 mailed Nov. 14, 2018.
International Search Report and Written Opinion from International Application No. PCT/US2020/044982 mailed Oct. 26, 2020.
Issue Notification for U.S. Appl. No. 15/500,991 mailed May 22, 2019.
Issue Notification for U.S. Appl. No. 15/516,834 mailed Aug. 12, 2020.
Issue Notification for U.S. Appl. No. 16/394,665 mailed Feb. 19, 2020.
Non-Final Office Action for U.S. Appl. No. 15/500,991 mailed Jan. 18, 2018.
Non-Final Office Action for U.S. Appl. No. 15/516,834 mailed Aug. 30, 2018.
Non-Final Office Action for U.S. Appl. No. 16/101,075 mailed Jun. 27, 2019.
Notice of Allowance for U.S. Appl. No. 15/500,991 mailed Jun. 18, 2018.
Notice of Allowance for U.S. Appl. No. 15/500,991 mailed Oct. 2, 2018.
Notice of Allowance for U.S. Appl. No. 15/516,834 mailed Apr. 1, 2020.
Notice of Allowance for U.S. Appl. No. 15/516,834 mailed Dec. 23, 2019.
Notice of Allowance for U.S. Appl. No. 15/516,834 mailed Jun. 26, 2019.
Notice of Allowance for U.S. Appl. No. 15/516,834 mailed Mar. 8, 2019.
Notice of Allowance for U.S. Appl. No. 16/101,075 mailed Feb. 2020.
Notice of Allowance for U.S. Appl. No. 16/394,665 mailed Oct. 30, 2019.
Supplemental Notice of Allowability for U.S. Appl. No. 15/516,834 mailed Apr. 29, 2020.
Supplemental Notice of Allowability for U.S. Appl. No. 16/101,075 mailed May 28, 2020.
U.S. Appl. No. 15/500,991, filed Feb. 1, 2017.

(56) References Cited

OTHER PUBLICATIONS

U.S. Appl. No. 15/516,834, filed Apr. 4, 2017.
U.S. Appl. No. 17/633,677, filed Feb. 8, 2022.
U.S. Appl. No. 62/044,738, filed Sep. 2, 2014.
U.S. Appl. No. 62/265,362, filed Dec. 9, 2015.
U.S. Appl. No. 62/549,853, filed Aug. 24, 2017.
U.S. Appl. No. 62/884,901, filed Aug. 9, 2019.
U.S. Appl. No. 63/174,663, filed Apr. 14, 2021.
U.S. Appl. No. 63/174,706, filed Apr. 14, 2021.
Notice of Allowance for U.S. Appl. No. 17/71,429 mailed Jul. 9, 2024.
Notice of Allowance for U.S. Appl. No. 17/715,429 mailed Oct. 15, 2024.
Restriction Requirement for U.S. Appl. No. 17/633,677 mailed Oct. 8, 2024.
Non-Final Office Action for U.S. Appl. No. 17/633,677 mailed Jan. 16, 2025,.
Notice of Allowance for U.S. Appl. No. 17/715,429 mailed Feb. 3, 2025,.
Notice of Allowance for U.S. Appl. No. 17/633,677 mailed May 8, 2025.
Corrected Notice of Allowance for U.S. Appl. No. 17/633,677 mailed May 14, 2025.
Issue Notification for U.S. Appl. No. 17/715,429 mailed Jul. 2, 2025.

* cited by examiner

BASE CONNECTIONS AND STRUCTURES INCLUDING THE BASE CONNECTIONS, KITS FOR FORMING AND METHODS OF REPAIRING THE SAME

BACKGROUND

A column of a structure is generally attached to foundations through a base connection. The column and the base connection are designed to resist forces that may arise from wind or earthquake loading. The structure including the column and the base connection may be configured to resist severe earthquake loads by relying on ductility to prevent catastrophic failure of the structure. For example, parts of the structure may be configured to yield in a controlled manner to accommodate the large swaying associated with severe earthquake shaking. In some structures, the column is configured to yield at or near the base connection to accommodate the large swaying.

It is difficult to repair a yielded column thus making the structure impractical to repair after the column has yielded. In other words, the structure that relies on the column yielding may result in a structure that is safe for severe earthquakes (i.e., the building will not collapse) but are not resilient (i.e., the structure may have to be demolished after the earthquake because the yielded column is difficult to repair).

SUMMARY

Embodiments are directed to base connections, structures including base connections, kits for forming the base connections and/or structures, and method of repairing yielded base connections. In an embodiment, a base connection is disclosed. The base connection includes a base plate including a top surface and a bottom surface opposite the top surface. The top surface is configured to be adjacent to a terminal end of a column and the bottom surface adjacent to a foundation. The base connection also includes one or more anchor rods attached to the base plate. The one or more anchor rods are configured to secure the base plate to the foundation. The base connection also includes at least one structural fuse configured to be attached to the column and attached to the base plate. The at least one structural fuse includes a plate with at least one cutout formed therein. The at least one cutout is configured to form one or more yield regions extending therefrom that are configured to preferentially yield relative to other regions of the plate.

In an embodiment, a structure is disclosed. The structure includes a column, a foundation, and a base connection. The base connection includes a base plate including a top surface and a bottom surface opposite the top surface. The top surface adjacent to a terminal end of a column and the bottom surface adjacent to a foundation. The base connection also includes one or more anchor rods attached to the base plate. The one or more anchor rods securing the base plate to the foundation. The base connection also includes at least one structural fuse attached to the column and the base plate. The at least one structural fuse including a plate with at least one cutout formed therein. The at least one cutout is configured to form one or more yield regions extending therefrom that are configured to preferentially yield relative to other regions of the plate.

In an embodiment, a kit is disclosed. The kit includes a base plate including a top surface and a bottom surface opposite the top surface, the top surface configured to be adjacent to a terminal end of a column and the bottom surface configured to be adjacent to a foundation. The kit further includes at least one structural fuse configured to be attached to the column and the base plate. The at least one structural fuse includes a plate with at least one cutout formed therein. The at least one cutout is configured to form one or more yield regions extend therefrom that are configured to preferentially yield relative to other regions of the plate.

In an embodiment, a method of repairing a yielded structural fuse is disclosed. The method includes detaching the yielded structural fuse from a column and a base plate. The base connection include the base plate including a top surface and a bottom surface opposite the top surface. The top surface adjacent to a terminal end of the column and the bottom surface adjacent to a foundation. The base connection also includes one or more anchor rods attached to the base plate. The one or more anchor rods secure the base plate to the foundation. The base connection further includes at least one structural fuse including a plate with at least one cutout formed therein. The at least one cutout configured to form one or more yield regions extend therefrom that are configured to preferentially yield relative to other regions of the plate. The at least one structural fuse includes the yielded structural fuse. The method also includes attaching a new structural fuse to the column and the base plate. The new structural fuse includes a new plate with at least one new cutout formed therein. The at least one new cutout is configured to form one or more new yield regions extending therefrom that are configured to preferentially yield relative to other regions of the plate.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the present disclosure, wherein identical reference numerals refer to identical or similar elements or features in different views or embodiments shown in the drawings.

DETAILED DESCRIPTION

Figure 1A:
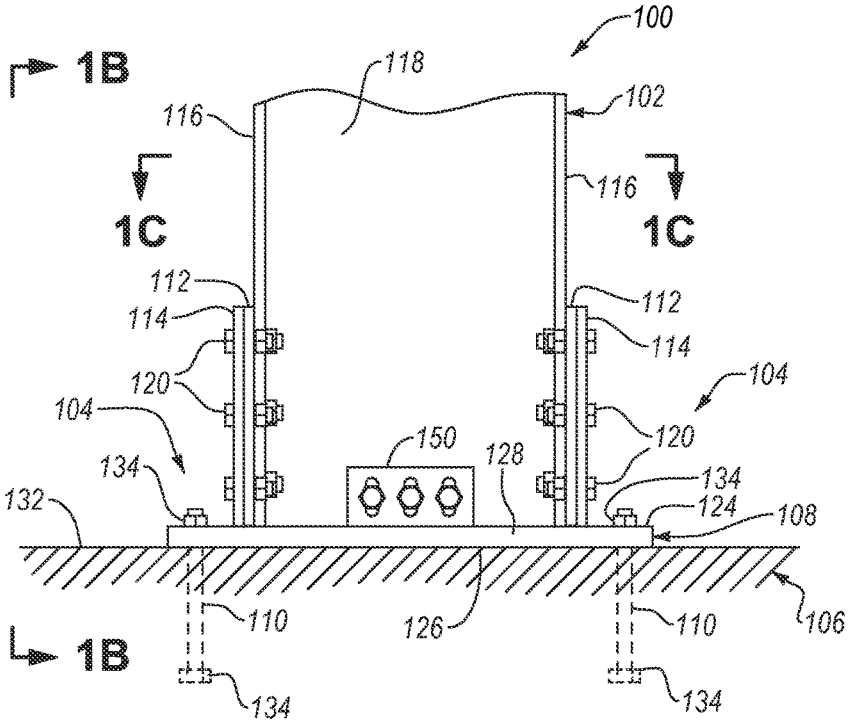
FIGS. 1A to 1C are lateral side, top, and frontal side views of a portion of a structure, according to an embodiment.

Embodiments are directed to base connections, structures including base connections, kits for forming the base connections and/or structures, and methods of repairing yielded base connections. An example base connection includes a base plate including a top surface and a bottom surface opposite the top surface. During use, the top surface of the base plate may be adjacent to a terminal end of a column and the bottom surface may be positioned adjacent to a foundation. The base plate further includes one or more anchor rods that are attached to the base plate and secure the base plate to the foundation. The base connection also includes at least one structural fuse that, during use, connects the column to the base plate. The structural fuse includes a plate with at least one cutout formed therein. The cutout is configured to form one or more yield regions extending therefrom.

The structural fuses disclosed herein are configured to preferentially absorb and dissipate energy from a load by preferentially yielding. As used herein, "yield," "yielding," and "yielded" may refer to failing, fracturing, plastically deforming, damaging or otherwise yielding an element (e.g., structural fuse) in a manner that may or may not require the replacement of the element after failure. Examples of loads that may cause yielding of the structural fuses include loads caused by a seismic event or wind. The structural fuses may absorb and dissipate some of the energy of loads applied to the structure that includes the base connection which may prevent or avoid yielding of the column that may otherwise result from the load. As such, the structural fuses disclosed herein may move yielding from the column to the structural fuses.

The base connection that includes the structural fuse is an improvement over a base connection that does not include the structural fuse (i.e., a base connection that includes a base plate and anchor rods). Several examples of base connections that do not include structural fuses are provided. In an example, the base connection that does not include the structural fuse may include a column welded to the base plate. In such an example, the base plate, the anchor rods, and the foundation are configured to be stronger than the column. That way, the column will yield rather than yielding the base plate, the anchor rods, or the foundation. When the column is relatively strong, a very thick base plate, numerous heavy anchor rods, and a substantial foundation are required in order to ensure that the base plate, anchor rods, and foundation are stronger than the column which may significantly increase project budgets. Regardless, the yielded column is difficult to remove and replace thereby making repairing the structure difficult or impractical after the column yields. In an example, the base connection that does not include the structural fuse may include a column welded to the base plate. In such an example, the base plate and/or the anchor rods of the base connection may be configured to yield instead of the column. However, similar to yielding the column, the base plate and the anchor rods may be difficult or impractical to repair after yielding since such repairs may require lifting the column off the base plate or removing portions of the foundation. In an example, the base connection that does not include the structural fuse may include one or more angles that attach the column to the base plate. The angles may be configured to yield. The yielded angle may be more easily repaired than if the column, the base plate, or the anchor rods yielded. However, attaching the column to the base plate using the angles results in a structure that is not stiff and is only partially restrained. In an example, the base connection that does not include the structural fuse may include at least one flange plate with slotted holes that attach the column to the base plate. In such an example, the flange plate may be bolted to the column and the bolts may slip in the slotted holes to accommodate the column swaying. In other words, the base connection relies on friction to dissipate energy. The flange plate with the slotted holes may prevent yielding of the base connection and the column thereby preventing the need to repair the base plate and the column. However, the flange plate with the slotted holes may have unreliable post-slip stiffness, poor strength, unpredictable bolt slip resistance, and the force required to cause the bolts to slip may change over time.

As previously discussed, the base connections that include a structural fuse are an improvement over base connections that do not include the structural fuse. For example, the structural fuses disclosed herein are configured to yield when a sufficiently large load is applied to the structure that includes the base connection. Yielding the structural fuse may prevent yielding of the base plate, the anchor rods, and the column. Unlike yielding the column, the base plate, and the anchor rods, repairing the yielded structural fuse may be relatively simple thereby causing such as structure that includes the structural fuse to be resilient (i.e., the structure does not need to be demolished after the structural fuse yields). Configuring the structural fuse to preferentially yield prevents the need to use very thick base plates, numerous heavy anchor rods, and substantial foundations, even when the base connection is attached to a relatively strong column. Further, the structural fuse may allow the stiffness of the connection between base connection and the column to qualify as a fully-restrained connection. The fully-restrained connection allows lighter beams and columns to be used in the structure than if the connection between the base connection and the column was a partially-restrained connection while maintaining the required overall stiffness. Finally, the expected load that causes the structural fuses to yield may be easier to predict than the expected load that causes the bolts to slip in the slotted holes of the flange plate. In particular, the load that causes the structural fuse to yield may be reliably predicted and will not change over time. Thus, the base connections including at least one structural fuse is an improvement over base connections that do not include a structural fuse.

Figure 1B:
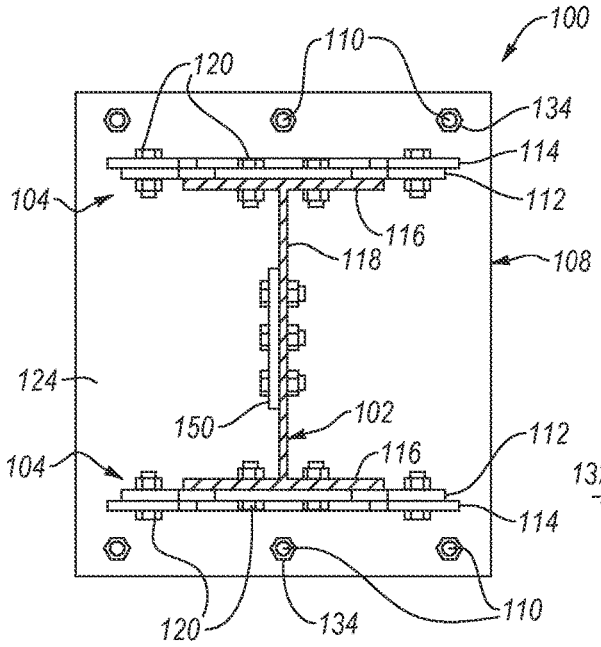
Figure 1C:
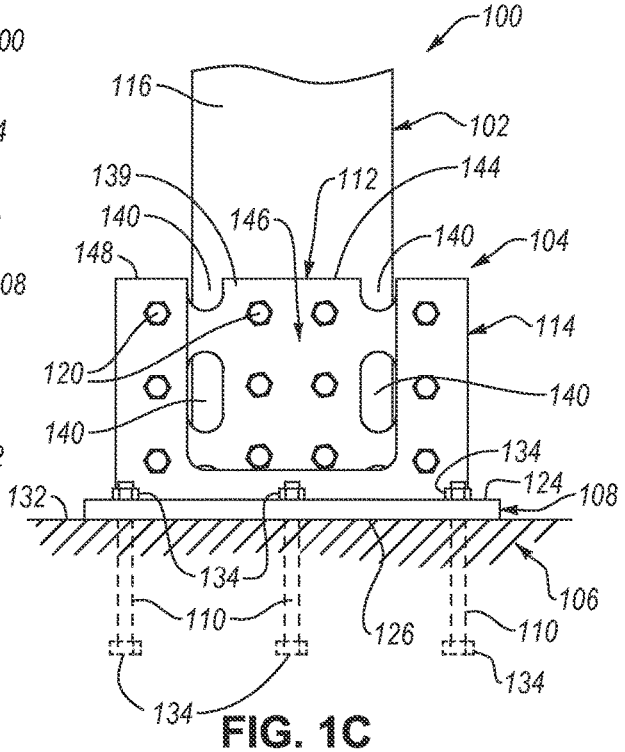
Figure 1D:
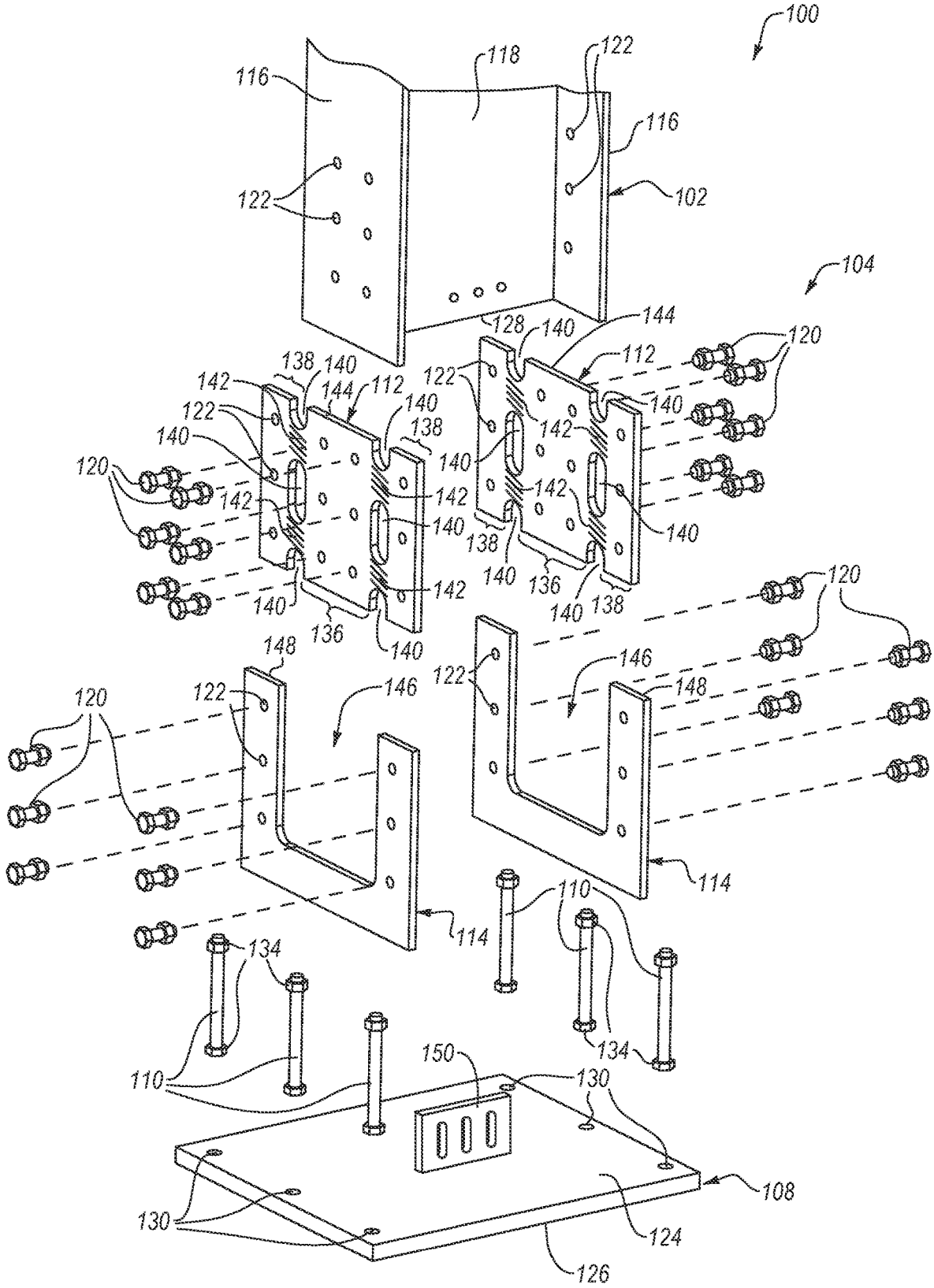
FIG. 1D is an exploded view of the structure illustrated in FIGS. 1A to 1C.

FIGS. 1A to 1C are lateral side, top, and frontal side views of a portion of a structure 100, according to an embodiment. FIG. 1D is an exploded view of the structure 100 illustrated in FIGS. 1A to 1C. The structure 100 includes a column 102, a base connection 104, and a foundation 106. The base connection 104 is configured to attach the column 102 to the foundation 106. The base connection 104 includes a base plate 108 and one or more anchoring rods 110. The anchoring rods 110 are configured to extend into the foundation 106 thereby securing the base plate 108 to the foundation 106. The base connection 104 also includes at least one structural fuse 112. The structural fuse 112 is configured to be attached to the column 102 and the base plate 108 thereby attaching the column 102 and the base plate 108 together. The structural fuse 112 is configured to preferentially yield when a sufficient load is applied to the structure 100 thereby preventing or at least inhibiting yielding of the column 102, the foundation 106, the base plate 108, and the anchor rods 110. In an embodiment, when the structural fuse 112 is indirectly attached to the base plate 108, the base connection 104 may include at least one flange plate 114 that is configured to connect the structural fuse 112 to the base plate 108.

In an embodiment, the column 102 includes an I-beam. In such an embodiment, the column 102 includes two flanges 116 with a web 118 extending between the two flanges 116. The structural fuse 112 may be attached (e.g., bolted, riveted, welded, etc.) to one or both of the two flanges 116. In an embodiment, the column 102 may include a structural beam other than an I-beam, such as a T-beam, an angle, a hollowed sectioned structural beam, or any other suitable structural beam.

The base plate 108 includes a top surface 124 and a bottom surface 126 opposite the top surface 124. The top surface 124 of the base plate 108 is configured to be adjacent to (e.g., directly contact) a terminal end 128 of the column 102. Generally, the top surface 124 extends outwardly from all of the outer edges of the terminal end 128 of the column 102. In other words, the base plate 108 is wider than the column 102. Extending the top surface 124 outwardly from all of the outer edges of the terminal end 128 of the column 102 better distributes the weight of the column 102 and the rest of the structure 100 attached to the column 102 (not shown) across the base plate 108. Further, extending the top surface 124 outwardly from all of the outer edges of the terminal end 128 of the column 102 provides portions of the base plate 108 in which anchor holes 130 may be formed. The bottom surface 126 is configured to be adjacent to the outer surface 132 of the foundation 106.

The base plate 108 may exhibit any suitable shape. In an example, the base plate 108 may exhibit a generally square, a generally rectangular, a generally circular, or a generally oval shape. In some examples, the base plate 108 may not include at least one cutout formed therein that weakens a portion of the base plate 108, similar to the cutout 140 of the structural fuse 112, since such a cutout formed in the base plate 108 may increase the likelihood that the base plate 108 yields. As previously discussed, repairing a yielded base plate 108 may be difficult or impractical.

As previously discussed, the anchoring rods 110 are configured to secure the base plate 108 to the foundation 106. In an embodiment, as illustrated, the anchoring rods 110 are configured to extend through the anchor holes 130 formed in the base plate 108 and disposed in the foundation 106 (e.g., the foundation 106 is formed around the anchor rods 110). The anchor rods 110 may include one or more threads formed thereon. The threads allow one or more nuts 134 to be secured to the anchor rods 110. In an example, at least one of the nuts 134 may be disposed outside of the foundation 106. In such an example, the nut 134 may exhibit a lateral dimension (e.g., diameter) that is greater than the lateral dimension of the anchor holes 130. As such, the nuts 134 may be disposed on the anchor rods 110 after the anchor rods 110 are disposed through the anchor holes 130 thereby securing the base plate 108 to the anchor rods 110. In an example, at least one of the nuts 134 are disposed in the foundation 106 which may better inhibit pullout of the anchor rods 110 from the foundation 106 than if the anchor rods 110 did not include the nuts 134 disposed in the foundation 106.

The base connection 104 may include any suitable number of anchor rods 110. For example, in the illustrated embodiment, the base connection 104 may include 6 anchor rods 110. However, the base connection 104 may include more than 6 anchor rods 110 (e.g., 7, 8, 9, 10, 11, 12, or more than 12) or fewer than 6 anchor rods 110 (e.g., 1, 2, 3, 4, or 5). As previously discussed, configuring the structural fuse 112 to preferentially yield allows the base connection 104 to include fewer anchor rods 110 than if a similar base connection was used that did not include the structural fuse 112, all other conditions the same, since the presence of the structural fuse 112 does not require the anchor rods 110 to be configured to resist yielding (e.g., the anchor rods 110, collectively, do not need to be stronger than the column 102, the base plate 108, etc.). The fewer anchor rods 110 makes forming the base connection 104 easier and cheaper.

Figure 2:
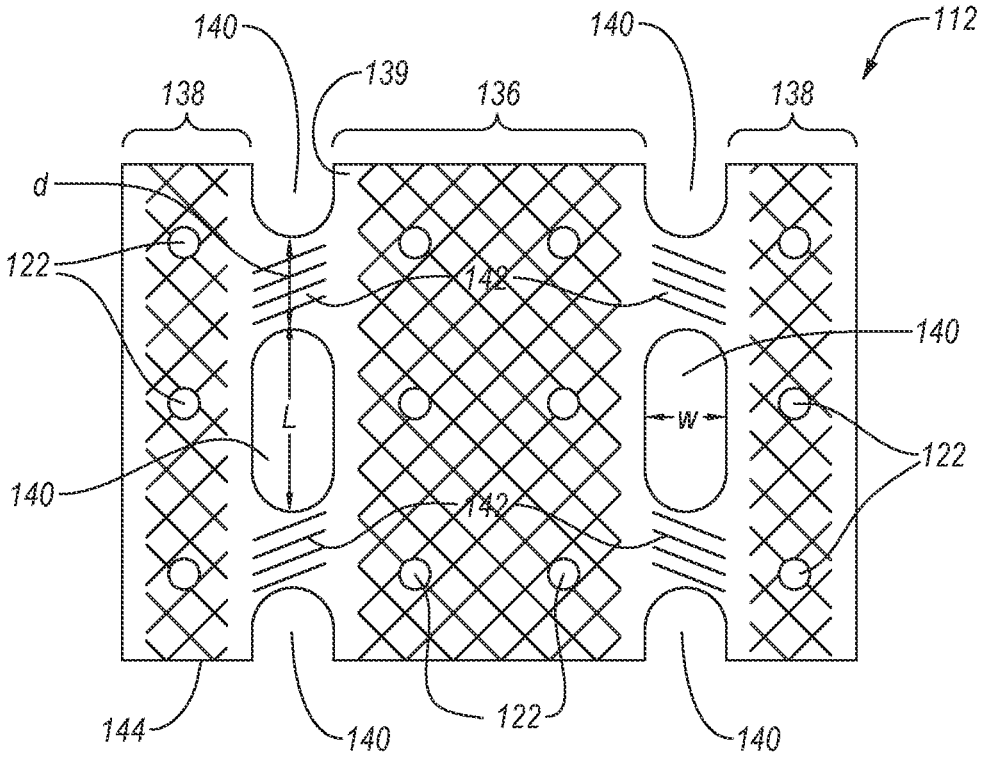
FIG. 2 is a front elevational view of a structural fuse illustrated in FIGS. 1A to 1D.

The structural fuse 112 is configured to be attached to the column 102 and the base plate 108. As such, as best shown in FIG. 2, which is a front elevational view of the structural fuse 112 illustrated in FIGS. 1A-1D, the structural fuse 112 may include one or more attachment regions that are configured to be attached to the column 102 and/or the base plate 108. In an embodiment, as illustrated, the structural fuse 112 includes at least one first connection region 136 and at least one second connection region 138. For illustrative purposes, the first and second connection regions 136, 138 are illustrated in FIG. 2 using diagonal intersecting lines. The first connection region 136 is configured to be attached to the column 102 and the second connection region 138 is configured to be attached (e.g., directly or indirectly attached), to the base plate 108. The first and second connection regions 136, 138 may be attached to the column 102 and the base plate 108, respectively, using any suitable technique. In an example, as illustrated, the first connection region 136 is configured to be attached to the column 102 using one or more bolts 120. As such, both the first connection region 136 and a portion of the column 102 configured to be attached to the structural fuse 112 includes one or more bolt holes 122 through which the bolts 120 may be disposed. Configuring the structural fuse 112 to be attached to the column 102 using the bolts 120 makes removal of the structural fuse 112 easier when the structural fuse 112 yields and needs to be replaced. In an example, the first connection region 136 may be attached to the column 102 via welding. Welding the first connection region 136 to the column 102 may make the connection between the base connection 104 and the column 102 more stiff but may make removing a yielded structural fuse (shown in FIG. 3B) more difficult. In an example, the second connection portion 138 may be attached to the base plate 108 indirectly using at least one flange plate 114, as will be discussed in more detail below. The second connection portion 138 may be configured to be attached to the flange plate 114 using one or more bolts 120 or rivets which may facilitate repair of the structural fuse 112 or one or more welds which may make the connection between the base connection 104 and the column 102 more stiff but may make repairing the structural fuse 112 more difficult. In an example, the second connection portion 138 may be directly welded to the base plate 108 which may make the connection between the base connection 104 and the column 102 more stiff but may make repairing the structural fuse 112 more difficult. It is noted that the structural fuse 112 may be attached to the column 102 and the base plate 108 (e.g., to the flange plate 114) using rivets or other attachment techniques instead of or in addition to bolts 120 or welds.

In an embodiment, the structural fuse 112 directly contacts the column 102. Directly contacting the structural fuse 112 to the column 102 may allow a spacer to be omitted from the base connection 104 that would otherwise need to be positioned between the structural fuse 112 and the column 102. Omitting the spacer decreases the complexity and cost of attaching the base connection 104 to the column 102. Omitting the spacer may also increase the stiffness of the connection between the column 102 and the base connection 104 (e.g., between the column 102 and the structural fuse 112). In other words, omitting the space may make the connection between the column 102 and the base connection 104 more fully restrained. In an embodiment, the structure 100 includes at least one spacer (not shown) between the structural fuse 112 and the column 102.

The structural fuse 112 includes at least one plate 139. The structural fuse 112 includes at least one cutout 140 formed in the plate 139. The cutout 140 is configured to weaken the plate 139 such that the plate 139 yields in selected regions of the plate 139. For example, the cutout 140 is configured such that the plate 139 yields in one or more yield regions 142 (illustrated in FIGS. 1D and 2 using non-intersecting lines). At least a portion (e.g., majority or all) of the yield regions 142 are distinct from at least a portion (e.g., majority or all) of the connection regions. As such, failure of plastic deformation of the yield regions 142 of the plate 139 are unlikely to affect the connection between the plate 139 and the other elements of the structure to which the structural fuse 112 is attached. In some embodiments, at least one of the cutout 140 and the yield regions 142 are positioned between the first and second connection regions 136, 138 which may facilitate yielding of the structural fuse 112.

In an embodiment, the cutout 140 may include an opening formed in the plate 139 that extends through the plate 139. The cutout 140 does not attach the structural fuse 112 to the column 102 or the flange plate 114. When the cutout 140 extends through the plate 139, the cutout 140 is distinguishable from the bolt holes 122 that are configured to receive the bolts 120 or rivets by the size of the cutout 140. In an example, the cutout 140 exhibits a maximum length or area that is significantly larger (e.g., at least 2 times larger, at least 5 times larger, or at least 10 times larger) than the bolt holes 122 and the maximum length may be about 1.5 cm or greater (e.g., about 2 cm or greater, about 3 cm or greater, about 4 cm or greater, about 5 cm or greater, about 7.5 cm or greater, or 10 cm or greater). The cutout 140 may be significantly larger than the bolt holes 122 since the cutout 140 is configured to selectively weaken the plate 139 whereas the bolt holes 122 are configured to have a negligible effect on the strength of the plate 139. In an example, the cutout 140 may be distinguishable from the bolt holes 122 because the cutout 140 exhibits a non-circular shape (e.g., elongated or square shape) while the bolt holes 122 are circular. In an embodiment, the cutout 140 may include a selectively thinned region of the plate 139.

The cutout 140 may extend inwardly from an edge 144 of the plate 139 or may be completely surrounded from the plate 139. In an example, the at least one cutout 140 may include a single cutout 140 that is completely surrounded by the plate 139. In an example, the at least one cutout 140 includes a single cutout 140 that extends inwardly from one edge 144 of the plate 139. In an example, the at least one cutout 140 includes a plurality of cutouts 140. In such an example, the plurality of cutouts 140 may extend inwardly from at least one edge 144 of the plate 139, be completely surrounded by the plate 139, or both (e.g., at least one cutout 140 extends inwardly from the edge 144 while at least one other cutout 140 is surrounded by the plate 139).

The cutout 140 may exhibit any suitable shape. Generally, the shape of the cutout 140 exhibits a generally rounded shape, such as circular or oblong shape, to prevent stress concentrators which may cause the structural fuse 112 to fail or plastically deform at unsatisfactory low loads. However, the cutout 140 may exhibit a non-rounded shape, such as a rectangular or square shape. The stress concentrators (e.g., corners) of such non-rounded shapes may allow for more control over which portions of the plate 139 are the yield regions 142. In an example, the cutout 140 may exhibit a longitudinally extending shape, such as an oblong, ellipsoid, or rectangular shape. The longitudinally extending shape may weaken region of the plate 139 that are aligned with the longitudinal axis of the longitudinally extending shape of the cutout 140 thereby allowing for more control of which portions of the plate 139 are the yield region 142. That is, the yield regions 142 are the portions of the plate 139 that are aligned with the longitudinal axis of the cutout 140.

Figure 3A:
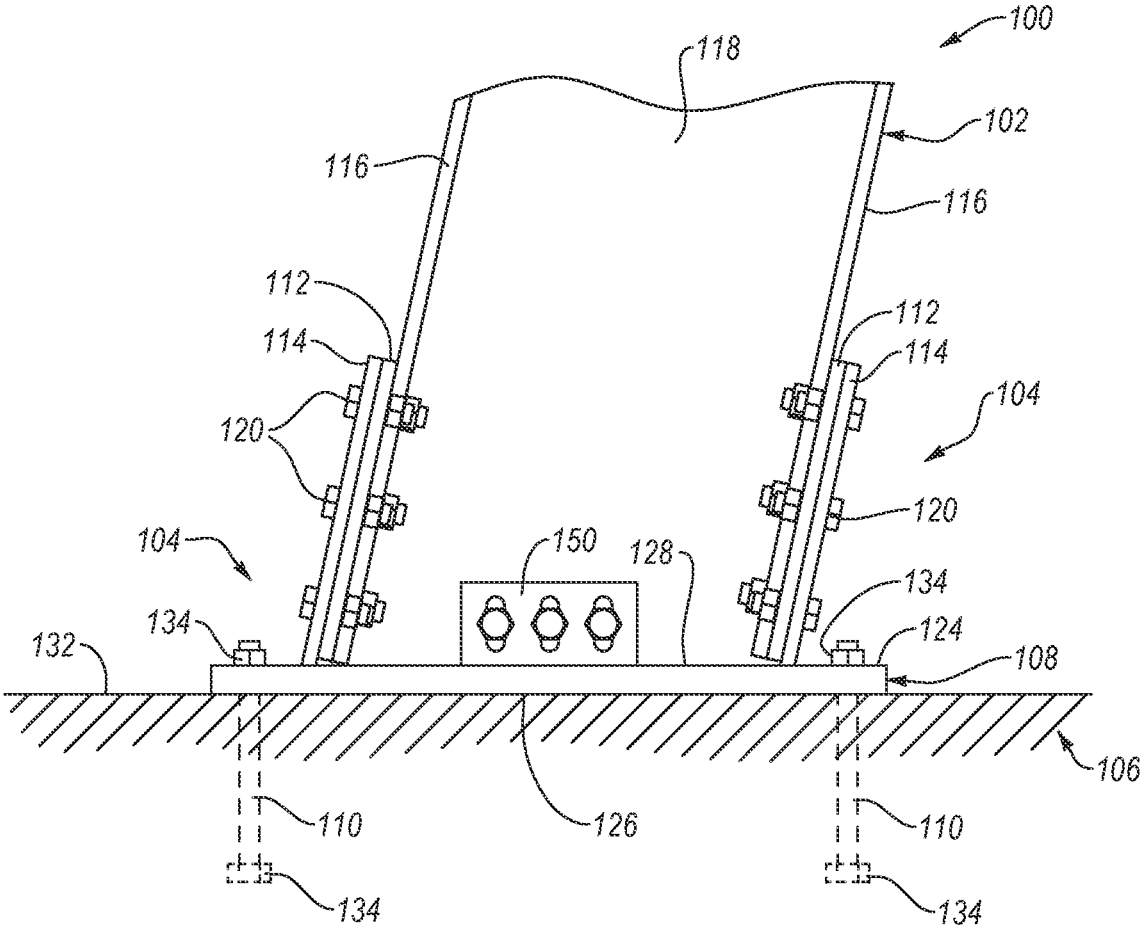
FIG. 3A is a side elevational view of the structure illustrated in FIGS. 1A-1D, according to an embodiment.
Figure 3B:
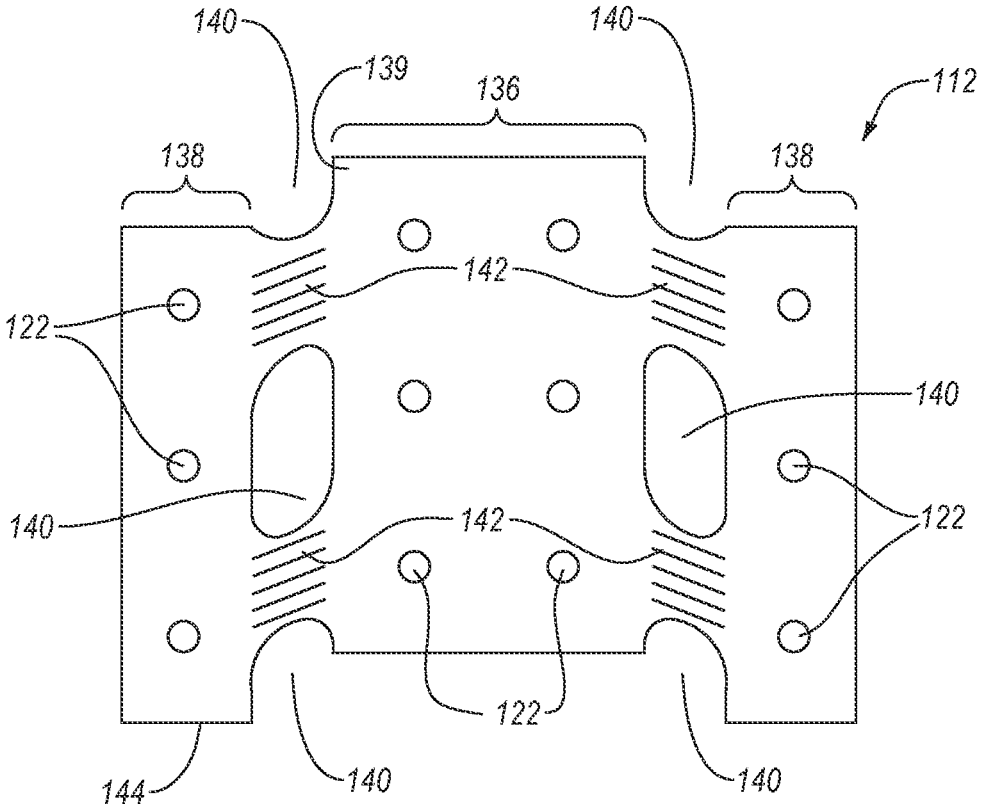
FIG. 3B is a front elevational view of a yielded structural fuse, according to an embodiment.

As previously discussed, the at least one cutout 140 may include a plurality of cutouts 140. In an embodiment, at least some of the plurality of cutouts 140 may be arranged on the plate 139 in at least one generally straight line. Arranging the plurality of cutouts 140 in a generally straight line causes the yield region 142 to be aligned and positioned on the generally straight line. As such, arranging the plurality of cutouts 140 in a generally straight line may allow for better control of which portions of the plate 139 that are yield region 142. However, as illustrated in FIGS. 3A and 3B, at least one of the plurality of cutouts 140 do not have to be arranged in a generally straight line.

As previously discussed, the plate 139 includes at least one yield region 142. The yield region 142 are portions of the plate 139 that are weakened by the cutout 140 such that the yield region 142 preferentially yield when a load is applied to the plate 139. In an example, the at least one cutout 140 includes a plurality of cutouts 140 and the yield region 142 is between adjacent ones of the cutouts 140. In such an example, the yield region 142 is between the adjacent cutouts 140 because the adjacent cutouts 140 weaken a portion of the plate 139 between the cutouts 140. For instance, the yield region 142 is between the cutout 140 and the edge 144 of the plate 139 nearest the cutout 140.

The direction that the yield region 142 extends from the cutout 140 effects which load applied to the structural fuse causes the yield region 142 to yield. For example, only loads that are generally parallel to the direction that the yield region 142 extends from the cutout 140 may cause the yield region 142 to yield. When a load is applied to the structural fuse 112 that is obliquely angled relative to the yield region 142, the obliquely angled load may be broken into a first load component that is generally parallel to the direction that the yield region 142 extends from the cutout 140 and a second load component that is perpendicular to the first load. The first load component may cause the yield region 142 to yield while the second load component is unlikely to cause the yield region 142 to yield.

The strength of the structural fuse 112 (e.g., the load that the structural fuse 112 may withstand without yielding) may be adjusted by controlling the thickness of the plate 139, the spacing d between adjacent cutouts 140, the length L of the cutouts 140 that is the maximum lateral dimension of the cutouts 140, and the width W of the cutouts 140 measure perpendicularly to the length L. Generally, increasing the thickness, increasing the spacing d, decreasing the length L, and decreasing the width W increase the strength of the structural fuse 112, and vice versa. In an example, the thickness of the plate 139 may be selected to be about 0.25 cm or greater, about 0.5 cm or greater, about 0.75 cm or greater, about 1 cm or greater, about 1.25 cm or greater, about 1.5 cm or greater, about 2 cm or greater, about 2.5 cm or greater, about 3 cm or greater, about 4 cm or greater, about 5 cm or greater, about 6 cm or greater, about 7 cm or greater, about 8 cm or greater, or in ranges of about 0.25 cm to about 0.75 cm, about 0.5 cm to about 1 cm, about 0.75 cm to about 1.25 cm, about 1 cm to about 1.5 cm, about 1.25 cm to about 2 cm, about 1.5 cm to about 2.5 cm, about 2 cm to about 3 cm, about 2.5 cm to about 4 cm, about 3 cm to about 5 cm, about 4 cm to about 6 cm, about 5 cm to about 7 cm, or about 6 cm to about 8 cm. In an example, the spacing d may be selected to about 2 cm or greater, about 3 cm or greater, about 4 cm or greater, about 5 cm or greater, about 6 cm or greater, about 7 cm or greater, about 8 cm or greater, about 10 cm or greater, about 12.5 cm or greater, about 15 cm or greater, about 20 cm or greater, about 25 cm or greater, or in ranges of about 2 cm to about 4 cm, about 3 cm to about 5 cm, about 4 cm to about 6 cm, about 5 cm to about 7 cm, about 6 cm to about 8 cm, about 7 cm to about 10 cm, about 8 cm to about 12.5 cm, about 10 cm to about 15 cm, about 12.5 cm to about 20 cm, or about 15 cm to about 25 cm. In an example, the width W of the cutouts 140 may be selected to be about 1 cm or greater, about 1.5 cm or greater, about 2 cm or greater, about 2.5 cm or greater, about 3 cm or greater, about 4 cm or greater, about 5 cm or greater, about 6 cm or greater, about 7.5 cm or greater, about 10 cm or greater, about 12.5 cm or greater, about 15 cm or greater, about 20 cm or greater, about 25 cm or greater, or in ranges of about 1 cm to about 2 cm, about 1.5 cm to about 2.5 cm, about 2 cm to about 3 cm, about 2.5 cm to about 4 cm, about 3 cm to about 5 cm, about 4 cm to about 6 cm, about 5 cm to about 7.5 cm, about 6 cm to about 10 cm, about 7.5 cm to about 12.5 cm, about 10 cm to about 15 cm, about 12.5 m to about 20 cm, or about 15 cm to about 25 cm.

Referring back to FIGS. 1A-1D, as previously discussed, the base connection 104 may include at least one flange plate 114 that attaches the structural fuse 112 to the base plate 108 though, it is noted, the flange plate 114 may be omitted. When the flange plate 114 is omitted, the structural fuse 112 may be attached to the base plate 108 via welding, using bolts or rivets (e.g., the structural fuse 112 is an angle), or any other suitable technique.

The flange plate 114 is configured to be attached to or integrally formed with the base plate 108. The flange plate 114 is also configured to be attached to the structural fuse 112. The flange plate 114 may be attached to the base plate 108 and the structural fuse 112 using any suitable technique. In an example, as illustrated, the flange plate 114 is configured to be attached to the base plate 108 via welding which may make the base connection 104 more stiff. However, it is noted that the flange plate 114 may be attached to the base plate 108 using bolts or rivets (e.g., the flange plate 114 is an angle) or any other suitable techniques. In an example, as illustrated, the flange plate 114 may be attached to the structural fuse 112 using one or more bolts 120 or rivets. In such an example, the flange plate 114 may define one or more bolt holes 122 that correspond to one or more of the bolt holes 122 formed in the structural fuse 112 (e.g., the bolts holes 122 of the second connection portion 138). Connecting the flange plate 114 to the structural fuse 112 with bolts 120 or rivets may facilitate removal of the structural fuse 112 from the base connection 104 when the structural fuse 112 yields. However, it is noted that that the flange plate 114 may be welded or otherwise attached to the structural fuse 112. In an embodiment, the flange plate 114 may be omitted from the base connection 104 when, for example, the structural fuse 112 is directly attached to the base plate 108.

The flange plate 114 may define an opening 146. The opening 146 may extend from an edge 148 of the flange plate 114. The flange plate 114 may exhibit a generally U-like shape when the opening 146 extends inwardly from the edge 148. Alternatively, the flange plate 114 may completely enclose the opening 146. The opening 146 of the flange plate 114 may be configured such that the first connection region 136 of the structural fuse 112 is not covered by the flange plate 114. As such, the opening 146 may allow access to the first connection region 136 when the structural fuse 112 is attached to the flange plate 114 and allow the structural fuse 112 to be attached or detached from the column 102. The opening 146 may also allow the structural fuse 112 to be attached to the column 102 with bolts 120 or other attachment mechanisms that would protrude outwardly from the structural fuse 112 without needing to form a recess in the flange plate 114 to accommodate such attachment mechanisms. In an embodiment, the flange plate 114 may define at least one recess that is configured to accommodate bolts 120, rivets, or another attachment mechanism that extend outwardly from the structural fuse 112 instead of the opening 146.

In an embodiment, the connection between the column 102 and the base connection 104 is sufficiently stiff to qualify as fully restrained connection. The fully restrained connection may allow for smaller columns to be attached to the base connection 104 than if the connection between the column 102 and the base connection 104 was only a partially restrained connection. In an embodiment, the connection between the column 102 and the base connection 104 is only a partially restrained connection.

In an embodiment, as previously discussed, a spacer (e.g., plate) between the column 102 and the structural fuse 112 may be omitted from the structure 100. Such a spacer may be omitted since the structural fuses disclosed herein are unlikely to buckle when in compression. Further, the spacer may be omitted since the structural fuse 112 directly contact the column 102 which makes the connection between the column 102 and the structural fuse 112 more stiff. In an embodiment, a cover plate that covers all or substantially all of the structural fuse 112 and is distinct from the flange plate 114 may be omitted from the structure 100. The cover plate may be omitted because the structural fuses disclosed herein are unlikely to buckle when compressed and the cover plate may interfere with the flange plate 114. In an embodiment, one or more post-tensioned bars may be omitted from the structure 100 since such post-tensioned bars are not necessary. In an embodiment, flange plates with slotted holes may be omitted from the structure 100 since the structural fuse 112 is configured to yield thereby absorbing and dissipating energy without needing bolt slips.

In an embodiment, the base connection 104 may include at least one shear tab 150 that is configured to connect the base plate 108 to the web 118 of the column 102. The shear tab 150 is distinct from the structural fuse 112 and the flange plate 114.

Figure 5:
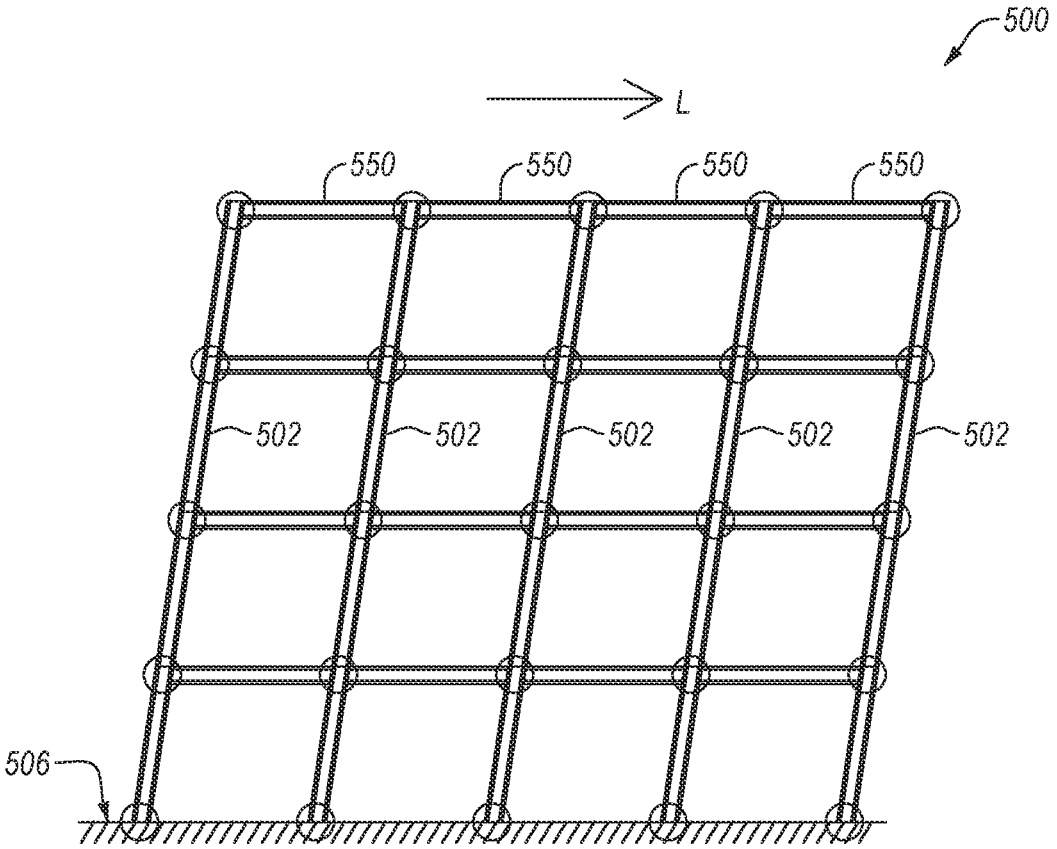
FIG. 5 is a side elevation view of a structure with a load applied thereto, according to an embodiment.

As previously discussed, the structural fuse 112 is configured to yield when a sufficiently large load is applied to the structure 100. FIG. 3A is a side elevational view of the structure 100 illustrated in FIGS. 1A-1D, according to an embodiment. FIG. 3B is a front elevational view of a yielded structural fuse 112, according to an embodiment. A load L may be applied to the structure 100. As illustrated in FIG. 5, the load L may cause the structure 100 to drift (i.e., sway) to the back. The load L may cause the back toe of the column 102 to bear on the base plate 108 which causes the front structural fuse 112 to yield. Likewise, when the structure 100 drifts to the front, the front toe of the column 102 bears on the base plate 108 which causes the back structural fuse 112 to yield.

As illustrated in FIG. 3B, yielding the structural fuse 112 causes the yield regions 142 of the structural fuse 112 to yield. The yielded yield regions 142 are illustrated using non-intersecting diagonal lines. The yielded yield regions 142 may allow the structural fuse 112 to deform thereby absorbing and dissipating energy caused by the load L. However, the yielded yield regions 142 do not affect the attachment between the first connection region 136 and the column 102 and the second connection region 138 and the base plate 108 (e.g., the second connection region 138 and the flange plate 114 when the structural fuse 112 is connected to the base plate 108 using the flange plate 114).

Figure 4:
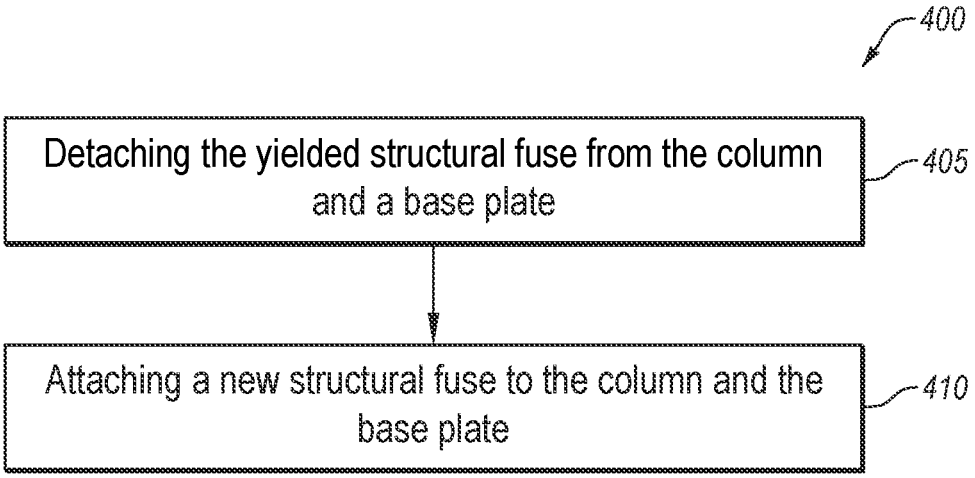
FIG. 4 is a flow chart of a method for repairing the structure, according to an embodiment.

After the structural fuse 112 yields, the structure 100 may be repaired. FIG. 4 is a flow chart of a method 400 for repairing the structure 100, according to an embodiment. The method 400 includes block 405, which recites "detaching the yielded structural fuse 112 from the column 102 and a base plate 108." In an embodiment, the yielded structural fuse 112 is bolted to at least one of the column 102 or the flange plate 114. In such an embodiment, block 405 may include unbolting the yielded structural fuse 112 from the column 102 or the flange plate 114. In an embodiment, the yielded structural fuse 112 is riveted to at least one of the column 102 or the flange plate 114. In such an embodiment, block 405 may include grinding away, cutting, or otherwise removing the rivets such that the yielded structural fuse 112 may be detached from the column 102 or the flange plate 114. In an embodiment, the yielded structural fuse 112 is welded to at least one of column 102, the base plate 108, or the flange plate 114. In such an embodiment, detaching the yielded structural fuse 112 may include separating (e.g., cutting) the structural fuse 112 from the component(s) to which the yielded structural fuse 112 is attached or grinding away at least a portion of the yielded structural fuse 112.

After block 405, the method 400 may include block 410, which recites "attaching a new structural fuse to the column 102 and the base plate 108." The new structural fuse may include any of the structural fuses disclosed herein. For example, the new structural fuse may be the same, substantially similar to, or different than the yielded structural fuse 112 before the yielded structural fuse 112 yielded. Attaching the new structural fuse to the column 102 and the base plate 108 may include at least one of bolting, riveting, welding, or otherwise attaching the new structural fuse to the column 102 and, either directly or indirectly via the flange plate 114, to the base plate 108. In an embodiment, the new structural fuse may be attached to the column 102 and the base plate 108 (e.g., indirectly via the flange plate 114) using the same method as the yielded structural fuse 112. In an embodiment, the new structural fuse may be attached to the column 102 and the base plate 108 using a method that is different than the yielded structural fuse 112.

The structural fuse illustrated in FIGS. 1A-3B is merely one example of a structural fuse that may be included in the structures disclosed herein. Further examples of structural fuses that may be used in the structures disclosed herein are disclosed in U.S. Provisional Patent Application No. 63/174,706 filed on Apr. 14, 2021, U.S. Pat. No. 10,689,876 filed on Aug. 10, 2018, U.S. Pat. No. 10,584,477 filed on Apr. 25, 2019, U.S. Pat. No. 10,316,507 filed on Aug. 26, 2015, U.S. Pat. No. 10,760,261 filed on Dec. 8, 2016, and International Application No. WO 2021/030111 filed on Aug. 5, 2020, the disclosures of each of which are incorporated herein, in its entirety, by this reference.

FIG. 5 is a side elevation view of a structure 500 with a load L applied thereto, according to an embodiment. The structure 500 includes a plurality of columns 502 and a plurality of beams 550. The plurality of columns 502 and the plurality of beams 550 are connected together to form the structure 500. The columns 502 may be secured to a foundation 506 using one or more base connections.

As previously discussed, one or more portions of the structure 500 may be configured to yield to absorb and dissipate energy from the load L applied to the structure 500 to prevent catastrophic failure of the structure 500. Examples of portions of the structure 500 that are configured to yield are indicated with circles on FIG. 5. As shown, in some embodiments, one or more portions of the beams 550 adjacent to the columns 502 and/or the beam-to-column connections are configured to yield to absorb and dissipate energy. In some embodiments, the columns 502 proximate to the foundation 506 or the base connections (not shown) that connect the columns 502 to the foundation 506 are configured to yield to absorb and dissipate energy. At least one of the base connections that secure one or more of the columns 502 to the foundation 506 is the same or substantially similar to any of the base connections disclosed herein that include a structural fuse. As such, the structural fuse of the base connection yields instead of the column 502. However, in some examples, at least one of the base connections that attach the columns 502 to the foundation 506 does not include a structural fuse. In such examples, at least one of the columns 502 yields, a portion of the base connections (e.g., the base plate or anchor rods) yields, or bolts slip in a slotted flange plate to absorb or dissipate energy from the load L.

In an embodiment, at least a portion of the structures disclosed herein (e.g., the base connections disclosed herein) may be provided as a kit. The kit may include at least a portion of base connection. The base connection may include, for example, the base plate, one or more anchoring rods, and the structural fuse. The kit may also include one or more nuts for the anchor rods. The kit may further include at least one flange plate when the structural fuse is attached to the base plate using the flange plate. The flange plate may be provided as being attached (e.g., welded) to the base plate or separate from the base plate. The kit may also include the column to which the base connection is attached. The kit may be provided with one or more components thereof attached together and/or one or more components thereof not attached together. The components of the kit may be the same or substantially similar to any of the components (e.g., columns, base plates, anchor rods, structural fuses, flange plate, etc.) disclosed herein.

While various aspects and embodiments have been disclosed herein, other aspects and embodiments are contemplated. The various aspects and embodiments disclosed herein are for purposes of illustration and are not intended to be limiting.

Terms of degree (e.g., "about," "substantially," "generally," etc.) indicate structurally or functionally insignificant variations. In an example, when the term of degree is included with a term indicating quantity, the term of degree is interpreted to mean±10%, ±5%, or +2% of the term indicating quantity. In an example, when the term of degree is used to modify a shape, the term of degree indicates that the shape being modified by the term of degree has the appearance of the disclosed shape. For instance, the term of degree may be used to indicate that the shape may have rounded corners instead of sharp corners, curved edges instead of straight edges, one or more protrusions extending therefrom, is oblong, is the same as the disclosed shape, etc.

What is claimed is:

1. A base connection, comprising:

a base plate including a top surface and a bottom surface opposite the top surface, the top surface configured to be adjacent to a terminal end of a column and the bottom surface configured to be adjacent to a foundation;

one or more anchor rods attached to the base plate, the one or more anchor rods configured to secure the base plate to the foundation;

at least one structural fuse configured to be attached to the column and attached to the base plate, the at least one structural fuse including a plate with at least one cutout formed therein, the at least one cutout configured to form one or more yield regions extending therefrom that are configured to preferentially yield relative to other regions of the plate; and at least one flange plate directly attached or integrally formed with the base plate, the at least one flange plate is distinct and separate from the at least one structural fuse, the at least one flange plate attachable to and detachable from the at least one structural fuse, wherein the at least one flange plate is oriented perpendicularly relative to the top surface of the base plate.

2. The base connection of claim 1, wherein the at least one structural fuse includes two structural fuses, each of the two structural fuses secured to one of two flanges of the column.

3. The base connection of claim 1, wherein the plate of the at least one structural fuse exhibits a thickness of about 0.5 cm to about 8 cm.

4. The base connection of claim 1, wherein each of the one or more yield regions extend from the at least one cutout in a first direction.

5. The base connection of claim 1, wherein the at least one cutout includes a plurality of cutouts separated by a spacing of about 5 cm to about 15 cm.

6. The base connection of claim 1, wherein the at least one cutout exhibits a maximum length and a width measured perpendicular to the maximum length that is less than the length, the width is about 2.5 cm to about 25 cm.

7. The base connection of claim 1, wherein the at least one structural fuse are bolted to the column.

8. The base connection of claim 1, wherein the at least one structural fuse is welded to the column.

9. The base connection of claim 1, wherein the at least one structural fuse directly contacts the column.

10. The base connection of claim 1, wherein the at least one flange plate at least partially defines at least one opening, the opening providing access to at least one region of the at least one structural fuse, wherein the at least one flange plate completely encloses the opening or exhibits a U-like shape.

11. The base connection of claim 10, wherein:

the at least one structural fuse is configured to be bolted to the column; and the at least one opening provides access to portions of the at least one structural fuse that are bolted to the column.

12. The base connection of claim 1, wherein the base connection is a fully-restrained connection.

13. The base connection of claim 1, wherein the one or more anchor rods include a first end; and wherein a portion of the one or more anchor rods extending from the first end is disposed in and surrounded by the foundation.

14. The base connection of claim 1, wherein the at least one structural fuse includes at least one first connection region and at least one second connection region that is distinct and separate from the at least one first connection region, the at least one first connection region configured to be connected to the column and the at least one second connection region configured to be connected to the at least one flange plate.

15. The base connection of claim 14, wherein the at least one flange plate at least partially defines at least one opening, the opening providing access to the at least one first connection region, wherein the at least one flange plate completely encloses the opening or exhibits a U-like shape.

16. A method of repairing a yielded structural fuse, the method comprising:

detaching the yielded structural fuse from a column and a base plate, the base connection including:

the base plate including a top surface and a bottom surface opposite the top surface, the top surface adjacent to a terminal end of the column and the bottom surface adjacent to a foundation;

one or more anchor rods attached to the base plate, the one or more anchor rods securing the base plate to the foundation; and at least one structural fuse including a plate with at least one cutout formed therein, the at least one cutout configured to form one or more yield regions extend therefrom that are configured to preferentially yield relative to other regions of the plate, the at least one structural fuse including the yielded structural fuse; and attaching a new structural fuse to the column and the base plate, the new structural fuse including a new plate with at least one new cutout formed therein, the at least one new cutout configured to form one or more new yield regions extending therefrom that are configured to preferentially yield relative to other regions of the plate wherein the base connection further includes at least one flange plate integrally formed with or configured to be attached to the base plate, the at least one flange plate is oriented perpendicularly relative to the tope surface of the base plate, the at least one flange plate configured to be attached to the at least one structural fuse, wherein detaching the yielded structural fuse from the base connection include detaching the yielded structural fuse from the at least one flange plate and attaching the new structural fuse to the column and the base plate includes attaching the new structural fuse to the at least one flange plate.

17. The method of claim 16, wherein:

detaching the yielded structural fuse from the base connection includes unbolting the yielded structural fuse from the column; and attaching the new structural fuse to the column and the base plate including bolting the new structural fuse to the column.

* * * * *